United States Patent [19]

Morris et al.

[11] 4,400,628

[45] Aug. 23, 1983

[54] CONTROL DEVICE AND METHOD OF MAKING

[75] Inventors: George E. Morris, Sterling; Stewart A. Woodward, Morrison, both of Ill.

[73] Assignee: General Electric Company, Fort Wayne, Ind.

[21] Appl. No.: 349,330

[22] Filed: Feb. 16, 1982

[51] Int. Cl.[3] ..... H01H 35/18; H01H 35/40

[52] U.S. Cl. ..... 307/118; 200/83 B

[58] Field of Search ..... 307/118; 200/83 R, 83 B, 200/83 N, 81.4

[56] References Cited

U.S. PATENT DOCUMENTS

| | | | |
|---|---|---|---|
| 3,243,539 | 3/1966 | Mazzeo | 200/83 B |
| 3,302,269 | 2/1967 | Cooper et al. | 200/83 B UX |
| 3,600,601 | 8/1971 | Ayres | 307/118 |
| 4,211,935 | 7/1980 | Erben | 307/118 |
| 4,256,973 | 3/1981 | Kochanski et al. | 307/118 |
| 4,343,974 | 8/1982 | Hire et al. | 200/81.4 X |

*Primary Examiner*—Donald A. Griffin
*Attorney, Agent, or Firm*—Joseph E. Papin

[57] ABSTRACT

A control device has a housing with an electrical circuit therethrough, and at least a pair of switch means are operable between a pair of switching modes for controlling the electrical circuit. Resistor means are connected in series circuit relation with one of the switch means in one of the switching modes thereof and in parallel circuit relation with the other of the switch means in one of the switching modes thereof. Means is provided for sequentially operating the switching means to the one switching modes thereof, respectively, to energize the resistor means in the series circuit relation with the one switching means prior to the connection of the resistor means in the parallel circuit relation with the other of the switching means.

A method of making the control device is also disclosed.

25 Claims, 8 Drawing Figures

CONTROL DEVICE AND METHOD OF MAKING

CROSS-REFERENCE TO RELATED APPLICATION

This application is related to the George E. Morris application Ser. No. 349,377 filed Feb. 16, 1982 entitled "Electrical Circuit And Method Of Controlling Such", the Thomas W. Brown application Ser. No. 349,378 filed Feb. 16, 1982 entitled "Electrical Circuit And Method Of Operating Such", and the Donald L. Haag application Ser. No. 349,329 filed Feb. 16, 1982 entitled "Control Device, Method Of Operating And Method Of Manufacturing", and each of the aforementioned related applications concurrently filed with this application is incorporated herein by reference.

FIELD OF THE INVENTION

This invention relates generally to automotive type air conditioning systems and in particular to a control device therefor and a method of making such control device.

BACKGROUND OF THE INVENTION

In the past, various different types of control devices, such as fluid pressure actuated switches for instance, were utilized in an automotive type air conditioning system to control the energization and deenergization of a clutch operated compressor in such system in response to a preselected low and a preselected high fluid pressure measured at a preselected point in such system, such as in an accumulator of such system for instance.

In some of the past control devices, a fluid pressure responsive member, such as a diaphragm or the like for instance, was sealably interposed in a control device housing so as to define therein a fluid pressure chamber and a switch means accommodating chamber adjacent opposite sides of the diaphragm, respectively. A snap disc, which may have various different configurations so as to be movable between a stable configuration and an unstable configuration, was provided with a circumferential edge seated in the switch means accommodating chamber on the control device housing and adjacent the diaphragm, and switch means operable generally between make and break positions for controlling an electrical circuit through the control device was disposed in the switch means accommodating chamber generally adjacent the snap disc. Thus, the diaphragm was movable in response to a preselected fluid pressure acting thereon in the fluid pressure chamber to effect the application of a motive or applied force to the snap disc thereby to cause snap-action movement of the snap disc from the stable configuration thereof toward the generally inverted or unstable configuration thereof. When the snap disc was so moved to its unstable configuration, it effected the movement of the switch means from its break position to its make position. Thereafter, in response to a preselected reduction in the fluid pressure in the fluid pressure chamber which effected a corresponding reduction in the motive force applied by the diaphragm of the snap disc, the snap disc returned with snap-action from its unstable configuration to its stable configuration thereby to permit the return movement of the switch means from its make position to its break position. Of course, in its make and break positions, the switch means completed and interrupted and circuit through the control device which effected the energization and deenergization of the aforementioned clutch device controlled or actuated compressor, respectively.

One of the disadvantageous or undesirable features of at least some of the past control devices is believed to be that the transition of the snap disc between the stable and unstable configurations thereof resulted in objectionable noise, such as a clicking noise for instance, which was audible in the passenger compartment of the automobile. For instance, since these control devices were mounted to the air conditioner accumulator, it is believed that the aforementioned objectionable noise was transmitted directly into the passenger compartment of the automobile. Another disadvantageous or undesirable feature of the past control devices is believed to be that the pumping action of the diaphragm resulting from the snap-action of the snap disc effected an undesirably large movement of ambient atmospheric air into and out of the switch means accommodating chamber of such control device; therefore, under certain atmospheric conditions, such pumping of the ambient air is believed to have resulted in the formation of condensation and/or the formation of frost within the switch means accommodating chamber of such control device which is also believed to be a disadvantageous or undesirable feature.

SUMMARY OF THE INVENTION

Among the several objects of the invention may be noted the provision of an improved control device and an improved method of making a control device which overcome the aforementioned disadvantageous or undesirable features, as well as others, of the prior art; the provision of such improved control device and method in which creep-type switching is utilized which is, in effect, noiseless; the provision of such improved control device and method in which calibration is simplified; the provision of such improved control device and method which utilizes a resistor which is energized in series circuit relation in an electrical circuit through the control device upon actuation of such control device in response to a preselected value of a control fluid pressure and which is thereafter energized in shunt circuit relation upon the subsequent completion of the electrical circuit through such control device when such control device is further actuated in response to another greater preselected value of the control fluid pressure; the provision of such improved control device and method in which heat generated by the resistor upon its energization acts to prevent accumulation of moisture and/or frost within such control device; and the provision of such improved control device and method utilizing components which are simplistic in design, easily assembled, and economically manufactured. These as well as other objects and features of the present invention will be in part apparent and in part pointed out hereinafter.

In general, a control device in one form of the invention has a housing with an electrical circuit therethrough, and at least a pair of switch means within the housing are operable generally between a pair of switching modes for controlling the electrical circuit through the housing. Resistor means adapted for energization in the electrical circuit are connected in series circuit relation with one of the switch means upon the operation of the one switch means to one of the switching modes thereof and also in parallel circuit relation with the other of the switch means upon the operation of the other switch means to one of the switching modes thereof. Means is provided for sequentially operating the switch means to the one switching mode thereof, respectively, to energize the resistor means in the electrical circuit in the series circuit relation with the one switch means prior to the connection of the resistor means in the parallel circuit relation with the other switch means.

Also in general and in one form of the invention, a method is provided for making a control device having a housing with a chamber therein, a plurality of terminals respectively including a switch section, at least a pair of switch elements, and a resistor. In this method, the at least pair of switch elements are secured in electrical conductive relation with the switch section of one of the terminals, and the resistor is connected in circuit relation between the switch sections of another two of the terminals, respectively. The switch section of the one terminal having the at least switch element pair secured thereto and the switch sections of the another two terminals having the resistor connected therebetween are arranged in the housing chamber with the switch sections of the another two terminals being disposed generally in adjacent spaced relation at different elevations in the housing chamber, and the at least switch element pair are positioned with respect to the switch sections of the another two terminals for making and breaking association therewith, respectively.

Further in general, a method is provided in one form of the invention for making a control device having a housing with a plurality of wall means defining a chamber therein, a plurality of terminals respectively including a switch section, at least a pair of switch elements, and a resistor having a pair of opposite leads extending therefrom. In this method, the resistor and leads therefore are placed in the chamber, and the leads are located generally in preselected positions at least adjacent a pair of the wall means of the housing. The switch section of one of the terminals is arranged in the chamber, and one of the leads of the resistor is captured between one of the wall means and the switch section of the one terminal in electrical conductive relation therewith. The switch section of another of the terminals is positioned in the chamber at an elevation different than that of the switch section of the one terminal, and the other of the leads of the resistor is captured between the other of the wall means and the switch section of the another terminal in electrical conductive relation therewith. The switch section of a third one of the terminals having the switch element pair secured thereto is disposed in the chamber, and a part of the switch element pair is located in overlaying relation with the switch sections of the one terminal and the another terminal for making and breaking association with respect thereto, respectively.

BRIEF DESCRIPTION OF THE DRAWINGS

Corresponding reference characters indicate corresponding parts throughout the several views of the drawings.

The exemplifications set out herein illustrate the preferred embodiments of the invention in one form thereof, and such exemplifications are not to be construed as limiting the scope of the invention in any manner.

DETAILED DESCRIPTION OF THE PREFERRED EMBODIMENTS

Figure 1:
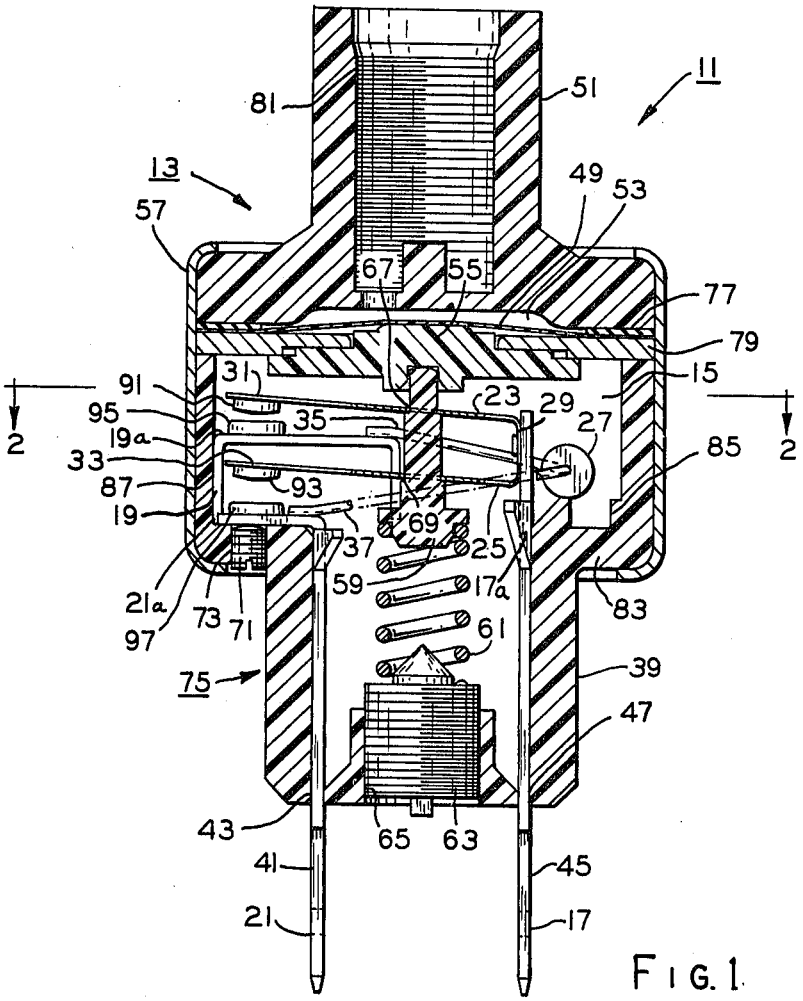
FIG. 1 is a sectional view of a control device in one form of the invention and illustrates principles which may be practiced in a method of making a control device also in one form of the invention.
Figure 2:
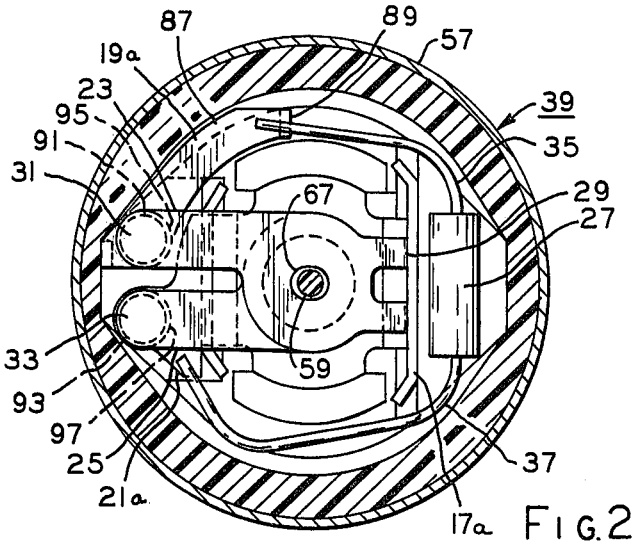
FIG. 2 is a sectional view taken along line 2—2 in FIG. 1.

With reference to the drawings in general, there is illustrated a method in one form of the invention of making or assembling a control device 11 having a housing 13 with a switch or switch means accommodating chamber 15 therein, a plurality of terminals 17, 19, 21 respectively including switch or supporting sections **17*a*, 19*a*, 21*a*, a pair of switch means or switch elements 23, 25, and a resistor 27 (FIGS. 1 and 2). In this method, switch elements 23, 25 are secured or otherwise connected or arranged in electrical conductive relation with switch section 17*a* of terminal 17, and resistor 27 is connected or otherwise associated in circuit relation between switch sections 19*a*, 21*a* of terminals 19, 21, respectively (FIGS. 1 and 2). Switch section 17*a* of terminal 17 having switch elements 23, 25 secured thereto and switch sections 19*a*, 21*a* of terminals 19, 21 having resistor 27 connected therebetween are arranged or otherwise positioned or located in chamber 15 so that switch sections 19*a*, 21*a* of terminals 19, 21 are disposed generally in adjacent spaced relation at different elevations or levels in the chamber, and the switch elements are also positioned or otherwise arranged or disposed with respect to switch sections 19*a*, 21*a* of terminals 19, 21 for making and breaking association therewith, respectively (FIG. 1**).

More particularly and with specific reference to FIGS. 1 and 2, switch elements 23, 25 of the slow make and break type may be formed from any suitable material having the desired resilient and conductive properties, such as a beryllium copper or the like for instance, and the switch elements are arranged at least in part in overlaying spaced relation having an integral end or end portion 29 interposed therebetween with a pair of free or contact carrying ends or end portions 31, 33 on the switch elements generally opposite the integral end portion thereof. Integral end portion 29 of switch elements 23, 25 is secured or otherwise connected in both mechanically supported and electrical conductive relation with switch section **17*a* of terminal 17 by suitable means, such as staking, riveting, soldering or the like for instance. While switch members 23, 25 are illustrated herein as being integrally formed with each other having integral end 29 thereof suitably mounted with switch section 17*a* of terminal 17, it is contemplated that other switch elements having different configurations and/or being separately formed with separate end portions thereof suitably mounted with the terminal switch section may be utilized within the scope of the invention so as to meet at least some of the objects thereof. Further, while only switch elements 23, 25 are illustrated herein for purposes of disclosure, it is also contemplated that at least an additional switch element might be employed and suitably electrically connected with terminal 17. Either before, after or concurrently with the forming of switch elements 23, 25 and the assembly thereof with terminal 17, a pair of opposite leads 35, 37 of resistor 27 may be connected or otherwise secured in both mechanical and electrical conductive relation with switch sections 19*a*, 21*a* of terminals 19, 21** by suitable means, such as soldering, welding, crimping or the like for instance, respectively.

Upon the assembly of switch elements 23, 25 with terminal 17 and the interconnection of resistor 43 between terminals 19, 21, switch sections **19*a*, 21*a* are located or otherwise placed or arranged at preselected locations therefor within switch chamber 15 provided in a lower housing member 39 of housing 13, and the resistor electrically connected between switch sections 19*a*, 21*a* of terminals 19, 21 is, of course, likewise located within the switch chamber concurrently therewith. During the location of terminals 19, 21 in switch chamber 15, as mentioned above, it may be noted that switch sections 19*a*, 21*a* of the terminals are predeterminately spaced apart at different spaced levels or elevations within the switch chamber, and an electrical connector section 41 of terminal 21, which is integrally formed with switch section 21*a* thereof, is extended or otherwise passed through a passage 43 provided therefor in lower housing member 39 so as to be disposed or to extend exteriorly of housing 13**.

When terminals 19, 21 are so assembled with lower housing member 39, switch section **17*a* of terminal 17 having switch elements 23, 25 secured thereto is then located or otherwise placed or disposed in a preselected location or position in switch chamber 15, and free ends 31, 33 of the switch elements are arranged or otherwise positioned or placed generally in overlaying relation with switch sections 19*a*, 21*a* of terminals 19, 21 at the different elevations or spaced levels thereof in the switch chamber, respectively. Generally as switch section 17*a* of terminal 17 is located in switch chamber 15, as discussed above, an electrical connector section 45 of terminal 17, which is integrally formed with switch section 17*a* thereof, is extended or otherwise passed through a passage 47 provided therefor in lower housing 39 so as to be disposed or to extend exteriorly of housing 13. Thus, with terminals 17, 19, 21 so positioned in switch chamber 15 of lower housing member 39, as discussed above, electrical connector sections 41, 45** are located generally in opposing or facing spaced apart relation exteriorly of the lower housing member.

Upon the assembly with lower housing member 39 of the component parts discussed above, a diaphragm or diaphragm means 49 is captured or otherwise interposed against displacement between the lower housing member and an upper housing member 51 of housing 13 so as to extend across or otherwise seal between switch chamber 15 in the lower housing member and a fluid pressure chamber 53 provided in the upper housing member, and a plunger or abutment 55 is positioned in the switch chamber between switch elements 23, 25 and the diaphragm in abutment therewith. While lower and upper housing members 39, 51 are illustrated therein as being retained against displacement from each other by a metallic sleeve 57 crimped or otherwise deformed into displacement preventing engagement therewith, it is contemplated that other suitable means well known to the art may be utilized to retain the upper and lower housing members in their assembled relation against displacement within the scope of the invention so as to meet at least some of the objects thereof.

Subsequent to the capturing of diaphragm 49 between upper and lower housing members 39, 51, an assembly including a spacer or engagement means 59, a spring or resilient means 61 and a threaded adjuster or adjusting means 63 is, at least in part, inserted or otherwise passed through a threaded opening 65 provided in the lower housing member, and the spacer is abutted or otherwise engaged with switch elements 23, 25 extending through a pair of generally aligned apertures or openings 67, 69 therein, respectively. Adjuster 63 may be threadedly engaged with threaded opening 65 in lower housing member 39 so as to abut spacer 59 against plunger 55 in switch chamber 15 compressing spring 61 between the adjuster and the spacer, and in this manner the compressive force of the spring is urged against the spacer so as to bias free ends 31, 33 of switch elements 23, 25 abutted with the spacer toward positions spaced from switch sections **19*a*, 21*a* of terminals 19, 21, respectively. The adjusted compression of spring 61 defines the force at which switch element 23 is actuated, as discussed hereinafter. To complete the description of the method of making or assembling control device 11, another adjusting means or adjusting screw 71 is threadedly received in another threaded opening 73 provided therefor in lower housing member 39 so as to abut or engage with switch section 21*a* of terminal 21, and an adjusting force applied on the adjusting screw results in the deformation or other adjusting disposition or movement of switch section 21*a* of terminal 21 thereby to predetermine or preselect the spacial relation, level or elevational difference between switch sections 19*a*, 21*a* of terminals 19, 21 within switch chamber 15. Of course, the adjusted elevational difference between switch sections 19*a*, 21*a* and also the gradient of spring 61 defines the force at which switch element 25 is actuated, as discussed hereinafter. While switch section 21*a* of terminal 21 is illustrated herein for purposes of disclosure as being deformable by adjusting screw 71 to attain the preselected elevational difference between switch sections 19*a*, 21*a* of terminals 19, 21, it is contemplated that the adjusting screw may threadedly protrude through switch section 21*a* in electrical conductive relation therewith so as to define an adjustable contact for making with switch element 25 and so as to be adjustably spaced from switch section 19*a*** to define the preselected elevational difference therebetween within the scope of the invention so as to meet at least some of the objects thereof.

Figure 3:
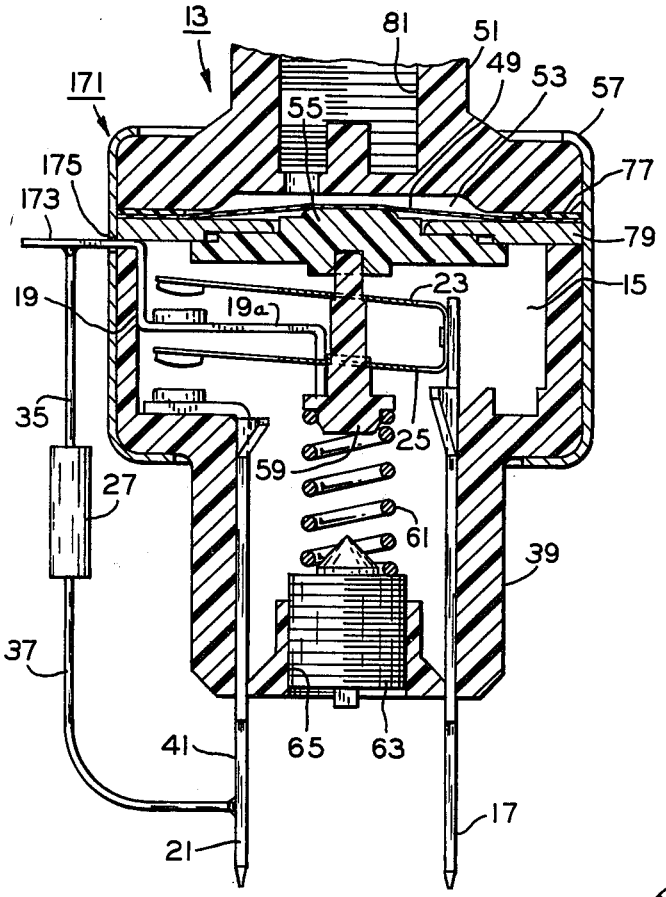
FIG. 3 is a partial sectional view taken from FIG. 1 illustrating an alternative control device in one form of the invention with the resistor connected in an electrical circuit of the alternative control device exteriorly thereof.

Referring again in general to the drawings and recapitulating at least in part with respect to the foregoing, control device 11 is illustrated in one form of the invention as having housing 13 with an electrical circuit therethrough, indicated generally at 75, and switch elements 23, 25 within the housing are operable generally between a pair of switching modes or positions for controlling the electrical circuit through the housing (FIG. 1). Resistor 27, which is adapted for energization in electrical circuit 75, is connected in series circuit relation with switch element 23 upon the operation of the switch element to one of the switching modes thereof and also in parallel circuit relation with switch element 25 upon its operation to one of the switching modes thereof (FIGS. 1-3). Means, such as at least diaphragm 49, is provided for sequentially operating switch elements 23, 25 to the one switching mode thereof, respectively, to energize resistor 27 in electrical circuit 75 in the series circuit relation with switch element 23 prior to the connection of the resistor in the parallel circuit relation with switch element 25 (FIG. 1).

More particularly and with specific reference again to FIG. 2, housing members 39, 51 may be formed of any suitable dielectric material, such as a resin or the like for instance, and means, such as metallic sleeve 57 or the like for instance, is connected or grippingly engaged with the housing members for displacement preventing engagement therewith, respectively. Although, upper housing member 51 is shown for purposes of disclosure as formed from a resin material and interconnected by metallic sleeve 57 with lower housing member 39, it is contemplated that upper housing member 51 may be metallic and directly connected to lower housing member 39 within the scope of the invention so as to meet at least some of the objects thereof. The peripheral or circumferential portion of diaphragm 49 is sealably interposed between a sealing means, such as a gasket 77 or the like for instance of suitable sealing material, and an annular metallic washer 79 and the gasket are respectively abutted between adjacent opposed ends of lower and upper housing members 39, 51, respectively. Thus, diaphragm 49 extends in sealing relation between opposed switch and fluid pressure chambers 15, 53 of lower and upper housing members 39, 51, and a control port 81, which is adapted to be connected with a source of fluid pressure (not shown), is provided in the upper housing member in pressure fluid communication with chamber 53 therein. Plunger 55 is guidably or slidably received by annular washer 79 extending therethrough into driven or abutting relation with a central portion of diaphragm 49, and the upper end portion of spacer 59 is guidably retained by plunger 55 so as to transmit thereto the compressive force of spring 61. As previously mentioned, spacer 59 is received through apertures 67, 69 in switch elements 23, 25, and spaced apart shoulders on the spacer abut with the switch elements urging them toward positions broken from switch sections 19*a*, 21*a* of terminals 19, 21, respectively, in response to the compressive force of spring 61 exerted on the spacer.

Lower housing member 39 is provided with an annular shoulder 83, and a groove 85 in the shoulder extends at least in part generally circumferentially about the lower housing member intersecting with switch chamber 37. Terminal or support member 19 is provided with a pair of seating flanges 87, 89 depending from switch section 19*a* as integral parts thereof, and flange 87 seats on housing shoulder 83 while flange 89 is press fitted or otherwise located in abutment within shoulder groove 85 thereby supporting or positioning the terminal in its preselected location within switch chamber 15 against displacement. To complete the description of control device 11, a pair of movable contacts 91, 93 are carried on free end portions 31, 33 of switch elements 23, 25 for making with and breaking from another pair of contacts 95, 97 contacts disposed on switch sections 19*a*, 21*a* of terminals 19, 21, respectively.

In the operation, assume that the component parts of control device 11 are disposed in the respective at-rest positions thereof as illustrated in FIGS. 1 and 2 and as described hereinabove. When a control fluid pressure of a preselected low value is established at control port 81, it acts on the effective area of diaphragm 49 in fluid pressure chamber 53 of upper housing member 51 to establish a control force acting against the adjusted compressive force of spring 61 and operable for effecting a slow or creep type actuation of switch elements 23, 25. Thus, as best seen in FIG. 1, diaphragm 49 is flexed or moved downwardly in response to the control force exerted thereon, and such downward movement of the diaphragm is translated therefrom through plunger 55 and spacer 59 which are conjointly movable with the diaphragm downwardly against the compressive force of spring 61. Of course, the inherent resiliency of switch elements 23, 25 effects the following or conjoint movement thereof downwardly with spacer 59, and upon this downward or pivotal movement of the switch elements about end portion 29 thereof, it may be noted that contact 91 on switch element 23 makes with contact 95 on switch section 19*a* of terminal 19 while contact 93 on switch blade 25 remains broken from contact 97 on switch section 21*a* of terminal 21. Thus, in the conductivity mode of switch element 23 with contact 91 thereon made with terminal contact 95, it may be noted that circuit 75 is completed through control device 11 from terminal 17 through switch element 23, the made contacts 91, 95, terminal 19, resistor 27 and its leads 35, 37 and therefrom to terminal 21. In this manner, when switch element 23 is made with switch section 19*a* of terminal 19 through contacts 91, 95 thereof, respectively, switch element 23 is placed in series circuit relation with resistor 27 across terminals 17, 21. It may then be noted that heat generated upon the energization of resistor 27 in switch chamber 15 acts to eliminate any condensation and/or frost which may have accumulated therein.

In the event of the increase of the control fluid pressure at control port 81 to a preselected high value greater than that initially supplied thereto, as discussed above, the control force acting on diaphragm 49 is correspondingly increased which, of course, effects the further conjoint downward movement of the diaphragm, plunger 55 and spacer 59 against the compressive force of spring 61. The resiliency of switch element 25 effects the further following or conjoint movement thereof with spacer 59 while switch element 23 remains made with switch section 19*a* of terminal 19 through made contacts 91, 95 thereof, respectively, and upon this further movement of switch element 25, contact 93 thereon becomes made with contact 97 on switch section 21*a* of terminal 21. Of course, the engagement between spacer 59 and switch element 23 is interrupted upon the further downward movement of the spacer to make switch element 25. Thus, in the conductivity mode of switch element 25 with contact 93 thereon made with terminal contact 97, it may be noted that circuit 75 is also completed through control device 11 from terminal 17 through switch element 25, the made contacts 93, 97 and terminal 21. It may also be noted that switch elements 23, 25 are sequentially made or actuated in circuit 75 in parallel circuit relation with each other, and resistor 27 remains energized in the circuit while being shunted when switch element 25 is made in circuit relation across terminals 17, 21.

When the control fluid pressure at control port 81 is eliminated, the control force acting on diaphragm 49 is, of course, also eliminated, and the compressive force of spring 61 returns or moves spacer 59, plunger 55 and the diaphragm conjointly upwardly to their original or at-rest positions in control device 11. Upon this return movement in response to the compressive force of spring 61, spacer 59 initially drives switch element upwardly breaking its contact 93 from terminal contact 97 thereby to interrupt circuit 75 through switch element 25 between terminals 17, 21; however, upon the breaking of switch element 25, it may be noted that switch element 23 is still made with switch section 19*a* of terminal 19 so that resistor 27 remains energized in the circuit across terminals 17, 21. Upon further return movement of diaphragm 49, plunger 55 and spacer 59 in response to the compressive force of spring 61 subsequent to the breaking of switch member 25 from switch section 21*a* of terminal 21, the spacer reengages switch element 23 to drive or move it upwardly, breaking its contact 91 from terminal contact 95 thereby to interrupt circuit 75 through resistor 21 between terminals 17, 19 and effect the deenergization of the resistor. Thus, it may be noted that switch elements 23, 25 are also sequentially broken in the parallel relation thereof in circuit 75, and resistor 27 remains energized in its parallel or shunt circuit relation across terminals 17, 21 subsequent to the breaking of switch element 25 thereacross until switch element 23 is also broken from switch section 19*a* of terminal 19. Upon the return of the component parts of control device 11 to their respective at-rest positions, the control device may be reactivated in the same manner described above upon the reestablishment of control fluid pressure at control port 81 of the control device.

In view of the foregoing, it may be noted that the actuation or movement of switch elements 23, 25 is of the creep type which, in effect, is noiseless, and due to such creep type actuation of the switch elements, movement of diaphragm 49 is rather slow which is believed to lessen air movement into and out of switch chamber 15.

Figure 4:
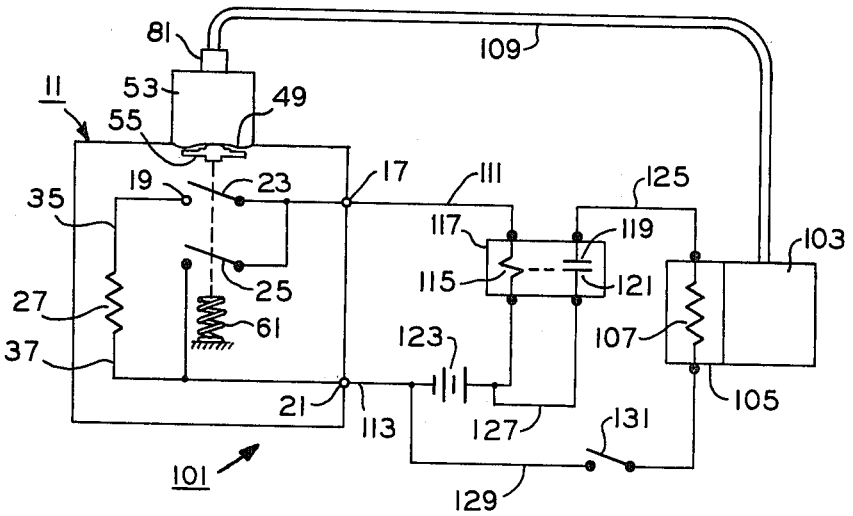
FIGS. 4 and 5 are schematic diagrams of circuits with the control devices of FIGS. 1 and 3 connected therein, respectively.

With reference to FIG. 4, control device 11 is shown connected in a control or D.C. circuit 101 adapted for use in an automotive type air conditioning system (not shown) to control the on-off operation of the air conditioning compressor 103 thereof, and control circuit 101 is a preferred embodiment of the George E. Morris application Ser. No. 349,377 filed Feb. 16, 1982 which is incorporated by reference herein, as previously mentioned. In control circuit 101, a clutch device 105 is provided with an electrical coil 107 which when energized effects the actuation of the clutch device to initiate the "on" or cooling mode operation of compressor 103. During this cooling mode operation, the air conditioning compressor pressurizes the refrigerant in the air conditioning system (not shown) associated therewith as is well known in the art, and control device 11 is adapted to be mounted on the low pressure side of the air conditioning compressor with control port 81 of the control device connected in pressure fluid communication with the pressurized refrigerant, i.e., control fluid pressure, in the accumulator of the air conditioning compressor by a conduit 109 interposed therebetween.

Terminals 17, 21 of control device 11 are respectively connected by a pair of leads 111, 113 across a coil 115 of a single pole, normally open relay or relay device 117 which may be a model 83053 available from the Gulf and Western Manufacturing Co., Farmington Hills, Mich., and when so connected with the relay, it may be noted that switch element 23 is arranged in series circuit relation with both resistor 27 and relay coil 115 while switch element 25 is arranged in parallel circuit relation with the resistor and in series circuit relation with the relay coil. Relay 117 is also provided with a pair of sets of contacts 119, 121 which, in the at-rest positions thereof, are open or broken and which are adapted to close or make in response to the energization of relay coil 115. Relay coil 117 typically picks up, i.e., is energized, so as to effect the closure of contact sets 119, 121 at a voltage several times that at which the relay coil drops out, i.e., becomes deenergized, to effect the opening of the contact sets, and typically the pickup voltage of the relay coil is about eight (8) volts while the dropout voltage is about three (3) volts. A power source, such as for instance a battery 123 or the like of the vehicle, for control circuit 101 is interposed in lead 113, and contact set 119 of relay 117 is connected by a lead 125 with one side of coil 107 in clutch device 105 while another lead 127 has one end connected with contact set 121 of the relay with the other end thereof terminating in connection with lead 113 between relay coil 115 and battery 123. The other side of coil 107 in clutch device 105 is connected by another lead 129 with lead 113 between terminal 21 of control device 11 and battery 123, and to complete the description of control circuit 101, an on-off type enabling switch 131 for the control circuit is interposed in lead 129.

With the component parts of control circuit 101 in their at-rest positions or deenergized conditions as illustrated in FIG. 4 and as described above, compressor 103 is, of course, idling or deactuated in the air conditioning system; therefore, at this time, the pressure developed in such air conditioning system is a direct function of the ambient or atmospheric temperature. When the vehicle operator desires to enable control circuit 101 to place the air conditioning system in the cooling mode thereof, the operator closes enabling switch 131, and assuming that the atmospheric temperature is high enough to effect the establishment of a preselected low fluid pressure, say for instance approximately 20 psig, such preselected low fluid pressure is transmitted through conduit 109 to control port 81 and fluid pressure chamber 53 of control device 11 acting on the effective area of diaphragm 49 to establish the control force which is effective to close switch element 23 against the compressive force of spring 61. When switch 23 is so closed, relay coil 115 is placed in series circuit relation with resistor 27 across battery 123. It should be noted that the resistance value of resistor 27 is preselected such that when switch element 23 is closed while switch element 25 is open, the voltage drop across relay coil 115 is greater than the aforementioned dropout voltage thereof but less than its pickup voltage. Therefore, the aforementioned closure of switch element 23 effects the energization of relay coil 115 but will not pickup the relay coil.

Assume further that the atmospheric temperature is great enough not only to effect the establishment of the preselected low fluid pressure but also a preselected high fluid pressure, say for instance approximately 40 psig. When diaphragm 49 in fluid pressure chamber 53 of control device 11 is subjected to this increased predetermined high fluid pressure, the control force exerted by the diaphragm is correspondingly increased, and switch element 25 is sequentially moved to its closed position against the compressive force of spring 61, as discussed in detail hereinbefore. Upon the subsequent closure of switch element 25 with switch element 23 closed, resistor 27 remains energized in shunt circuit relation across terminals 17, 21 of control device 11, and relay coil 115 is directly connected in circuit relation across battery 123 which, of course, causes the relay coil to pickup. When relay coil 115 picks up, it acts to effect the closure of contact sets 119, 121 in relay 117, and upon the closure of the relay contact sets, coil 107 in clutch device 105 is energized across battery 123. The energization of clutch coil 107 is effective to actuate clutch 105 into its coupling engagement with air conditioning compressor 103 to place or otherwise drive it in the cooling mode thereof.

During the cooling mode operation of compressor 103, the fluid pressure in the automotive air conditioning system is reduced, as well known in the art, and in response thereto, the control fluid pressure at fluid pressure chamber 53 of control device 11 and the control force exerted by diaphragm 49 thereof are correspondingly reduced. When the fluid pressure in the air conditioning system is reduced below the preselected high value thereof, the compressive force of spring 61 overcomes the control force exerted by diaphragm 49 and is effective to move or return switch element 25 to its open position; however, it may be noted that at the time switch element 25 is opened, switch element 23 remains closed. Thus, even though switch element 25 is opened, relay coil 115 remains energized or picked up in its series circuit relation with closed switch element 23 and resistor 27 across battery 123 because the voltage drop across the relay coil is greater than the dropout voltage thereof, as previously discussed. Of course, as the fluid pressure in the air conditioning system is further reduced below the preselected low value thereof, the control fluid pressure in fluid pressure chamber 53 of control device 11 and the control force exerted by diaphragm 49 thereof are correspondingly reduced, and the compressive force of spring 61 is then effective to move or return switch element 23 to its open position. The opening of switch element 23 interrupts the series circuit relation therewith of both resistor 27 and relay coil 115 across battery 123 thereby to effect the deenergization of the resistor and the relay coil causing it to drop out. Of course, the dropout of relay coil 115 effects or results in the opening of contact sets 119, 121 in relay 117 which, in turn, effects the deenergization of coil 107 in clutch device 105 across battery 123. When clutch coil 107 is so deenergized, clutch device 105 is deactuated from its coupling relation with compressor 103 thereby to interrupt the cooling mode of the compressor. So long as enabling switch 131 is closed, control circuit 101 will effect the operation or cycling of compressor 103 between its "off" mode and its cooling mode when the fluid pressure in the air conditioning system again increases to at least the preselected high value thereof.

It should be noted that control circuit obviates the possibility of undesirable chatter of clutch device 105 which results in undue wear of the clutch device and perhaps premature failure thereof. For instance, even if the contacts associated with switch element 25 did chatter upon the making or closure thereof, the circuit to effect energization or pickup of relay coil 115 is already completed through the previously made or closed switch element 23. Furthermore, even if the contacts associated with switch element 23 happened to chatter upon the closure thereof, switch element 23 can not effect the energization of relay coil 115 due to the voltage drop across resistor 27. Thus, it may be further noticed that each switch element 23, 25 can only energize or deenergize relay coil 115, they can not do both.

Figure 6:
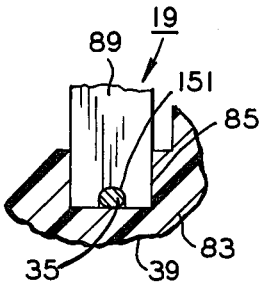
FIGS. 6 and 7 are partial sectional views illustrating principles which may be practiced in an alternative method of making the control valve of FIG. 1 in one form of the invention.
Figure 7:
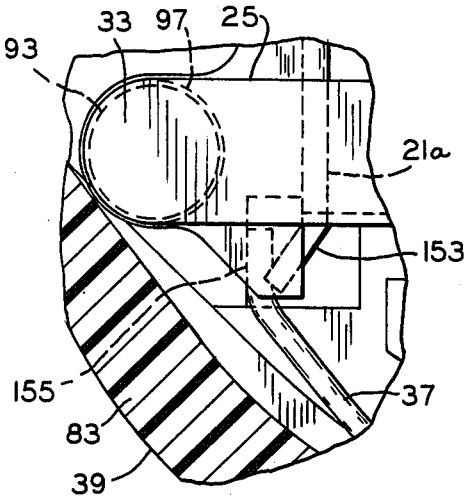

An alternative construction for control device 11 in one form of the invention is illustrated in FIGS. 6 and 7, and as best seen in FIG. 6, flange 89 of terminal 19 is provided with a notch 151 therein. Thus, when flange 89 is press fitted into groove 85 in shoulder 83 of lower housing member 39, as previously discussed, lead 35 of resistor 27 is captured within notch 151 between terminal flange 89 and a base wall or wall means of the groove in conductive relation with the terminal flange. Similarly, as illustrated in FIG. 7, lead 37 of resistor 27 is captured or otherwise trapped in conductive relation between a part, such as a bent ear 153 or the like for instance, of switch section **21*a* on terminal 21 and a wall means or portion of another notch 155 provided in shoulder 83 of lower housing member 39**.

With reference again to the drawings in general, there is also disclosed an alternative method in one form of the invention for making or assembling control device 11 with the control device including housing 13 having a plurality of wall means defining chamber 15 therein, a plurality of terminals 17, 19, 21 respectively having switch sections **17*a*, 19*a*, 21*a*, switch elements 23, 25, and resistor 27 having leads 35, 37 (FIGS. 1, 6 and 7). In this method, resistor 27 and its leads 35, 37 are placed or otherwise positioned in chamber 15, and the leads are generally located at least adjacent wall means, such as the base wall of groove 85 and notch 155 in shoulder 83, in housing 13 (FIG. 1). Switch section 21*a* of terminal 21 is arranged in chamber 15, and lead 37 of resistor 27 is captured in notch 155 between shoulder 83 of lower housing member 39 and ear 153 of the terminal switch section in electrical conductive relation therewith (FIG. 7). Switch section 19*a* of terminal 19 is positioned in chamber 15 at an elevation different than that of terminal switch section 21*a*, and lead 35 of resistor 27 is captured between base wall of housing groove 85 and flange 89 on terminal switch section 19*a* in electrical conductive relation therewith (FIG. 6). Switch section 17*a* of terminal 17 having switch elements 23, 25 secured thereto is disposed in chamber 15, and free end portions 31, 33 are located or otherwise arranged in overlaying relation with terminal switch sections 19*a*, 21*a* for making and breaking association therewith, respectively (FIG. 1**).

In FIG. 3, an alternative control device 171 is shown in one form of the invention having generally the same component parts and functioning generally in the same manner as the previously described control device 11 with the exceptions discussed hereinafter, and while control device 171 meets at least some of the objects set out hereinafter, it is believed that control device 171 may have other indigenous objects and advantageous features which will be in part apparent and in part pointed out.

In control device 171, terminal 17 has an electrical connector section 173 which is extended or otherwise passed through an opening 175 provided therefor in lower housing member 39 so as to be disposed exteriorly of housing 13, and leads 35, 37 of resistor 27 are connected in electrical conductive relation with electrical connector sections 173, 41 of terminals 17, 21, respectively, wherein the resistor is mounted to control device 11 exteriorly of housing 13 thereof.

Figure 8:
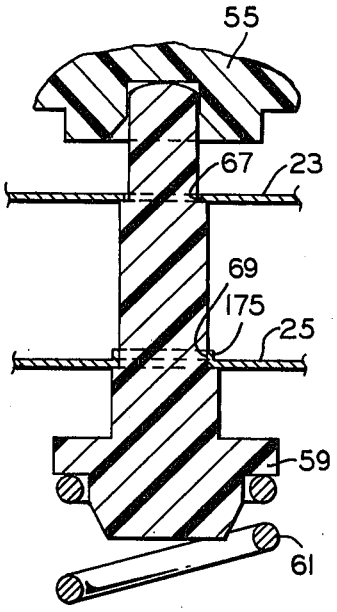
FIG. 8 is a partial sectional view illustrating an alternative construction for associating the switch elements and spacer of the control devices in FIGS. 1 and 3.

As best seen in FIG. 8, switch element 25 is attached by suitable means, such as for instance crimping or swagging at 175, about aperture 69 therein into displacement preventing engagement with spacer 59; however, it is contemplated that other suitable means may be employed to effect the displacement preventing engagement of switch element 25 and spacer 59. When spacer 59 is so attached to switch element 25, the spacer is, of course, located in chamber 15 of lower housing member 39 along with terminal 17 having switch elements 23, 25 secured thereto, as previously discussed. Spring 61 may thereafter be passed through opening 65 in lower housing member 39 into retaining engagement with spacer 59 so as to be compressed between the spacer and adjuster 63 upon the threaded engagement thereof with opening 65.

Figure 5:
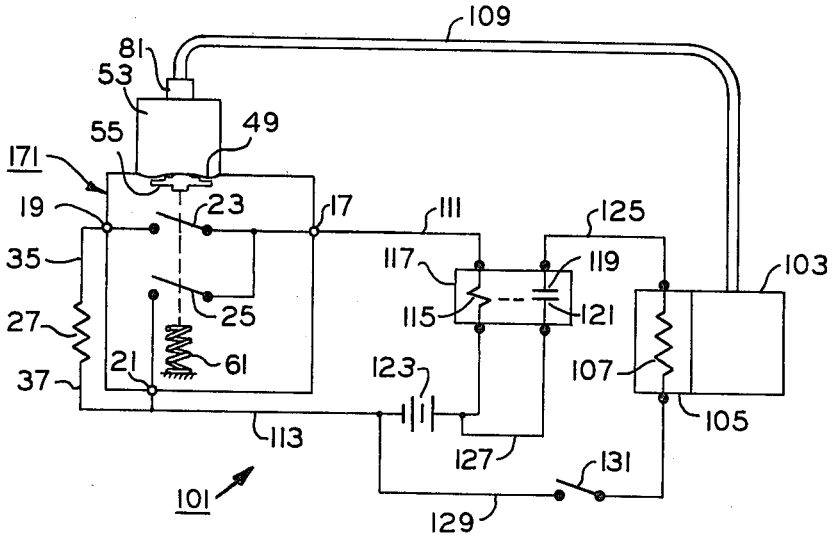

In FIG. 5 control device 171 is shown connected in control circuit 101, and control device 171 is operable in control circuit 101 in the same manner as control device 11, as discussed hereinabove.

From the foregoing, it is now apparent that novel control devices 11, 171 and novel methods of making or assembling such control devices are presented meeting at least the objects and advantageous features set out hereinbefore, and it is contemplated that changes as to the precise arrangements, shapes, connections and details of the constructions illustrated herein by way of example for purposes of disclosure, as well as the precise steps and order thereof of the methods, may be made by those having ordinary skill in the art without departing from the spirit of the invention or the scope thereof as defined by the claims which follow.

What we claim as new and desire to secure by Letters Patent of the United States is:

1. A control device comprising:

a pair of housing members secured together against displacement;

diaphragm means interposed between said housing members for defining a pair of expansible chambers therein, respectively;

a control port in one of said housing members intersecting with one of said chambers therein and adapted to be subjected to fluid pressure;

a pair of terminals mounted to the other of said housing members and respectively including a pair of electrical connector sections extending from the other of said chambers exteriorly of said other housing member, and a pair of supporting sections within said other chamber;

a support member disposed in said other chamber and having an elevation in said other chamber different than said one supporting section of said one terminal;

a first pair of contacts on said support member and said one supporting section of said one terminal;

a resistor in said other chamber and electrically connected across said support member and said one supporting section of said one terminal;

a pair of movable switch elements electrically interconnected with each other and with the other of said supporting sections of the other of said terminals and biased toward said one supporting section of said one terminal and said supporting member, and said switch elements including a pair of generally aligned openings therethrough, respectively;

a second pair of contacts on said switch elements arranged to make with said first contact pair and break therefrom, respectively;

means extending through said openings in said switch elements for engagement therewith and with said diaphragm means;

resilient means having a compressive force exerted on said engagement means so as to urge said engagement means against said switch elements and said diaphragm means for breaking said second contact pair on said switch elements from said first contact pair on said other supporting section of said other terminal and said supporting member, respectively;

first adjusting means threadedly received in said other housing member and associated with said other supporting section of said other terminal for adjusting the elevation of one of said contacts of said first contact pair on said other supporting section of said other terminal with respect to the other of said contacts of said first contact pair on said supporting member; and second adjusting means threadedly received in said other housing member and associated with said resilient means for adjusting the compressive force thereof exerted on said engagement means, said diaphragm means being initially movable against the compressive force of said resilient means in response to the establishment of fluid pressure of a preselected value at said control port to effect the movement of one of said switch elements toward a position making one of said contacts of said second contact pair thereon with said other contact of said first contact pair on said support member thereby to connect said resistor in circuit relation across said terminals and said diaphragm means being thereafter further movable against the compressive force of said resilient means in response to an increase in the established fluid pressure at said control port to another preselected value greater than the first named preselected value to effect the movement of the other of said switch elements toward a position in circuit relation across said terminals making the other of said contacts of said second contact pair on said other switch element with said one contact of said first contact pair on said other supporting section of said other terminal subsequent to the connection of said resistor in circuit relation across said terminals.

2. A control device comprising:

a housing having a pair of chambers therein with one of said chambers adapted to be subjected to a control fluid pressure;

at least a pair of terminals mounted to said housing and including an electrical connector section extending from the other of said chambers exteriorly of said housing, and another section within said other chamber, respectively;

at least one conductive member in said other chamber;

at least a pair of switch means mounted with said another section of one of said terminals within said other chamber and operable generally toward switching positions for placing said one terminal in circuit relation with the other of said terminals and said at least one conductive member, respectively;

solid state means connected in circuit relation between said at least one conductive member and said other terminal and adapted for energization upon the movement of one of said switch means toward its switching position placing said at least one conductive member and said one terminal in circuit relation; and means associated with said housing between said chambers and operable generally when subjected to the control fluid pressure in said other chamber for sequentially effecting the movement of said one switch means toward its switching position prior to effecting the movement of the other of said switching means toward its switching position placing said one terminal in circuit relation with said other terminal.

3. A control device as set forth in claim 2 wherein said switch means are integrally connected.

4. A control device as set forth in claim 2 further comprising means for adjusting the spacial relation within said other chamber between said another section of said other terminal and said at least one conductive member.

5. A control device as set forth in claim 2 further comprising means for exerting a force onto said sequentially effecting movement means opposing movement thereof when subjected to the control fluid pressure.

6. A control device as set forth in claim 5 wherein said force exerting means includes abutment means for engagement with said switch means, respectively.

7. A control device as set forth in claim 6 wherein said force exerting means further includes means for resiliently urging said abutment means toward the engagement thereof with said switch means, respectively.

8. A control device comprising:

a housing having an electrical circuit therethrough;

at least a pair of switch means within said housing and operable generally between a pair of switching modes for controlling said electrical circuit through said housing;

resistor means adapted for energization in said electrical circuit, said resistor means being connected in series circuit relation with one of said switch means upon the operation of said one switch means to one of the switching modes thereof and also in parallel circuit relation with the other of said switch means upon the operation of said other switch means to one of the switching modes thereof; and means for sequentially operating said switch means to the one switching mode thereof, respectively, to energize said resistor means in said electrical circuit in the series circuit relation with said one switch means prior to the connection of said resistor means in the parallel circuit relation with said other switch means.

9. A control device as set forth in claim 8 further comprising at least three terminals in said housing, said switch means being connected to one terminal of said at least three terminals and being made with another two terminals of said at least three terminals when said switch means are in the one switching mode thereof, respectively, and said resistor means being connected between said another two terminals.

10. A control device as set forth in claim 9 wherein at least some of said at least three terminals include an electrical connector section extending exteriorly of said housing.

11. A control device as set forth in claim 8 wherein said switch means are integrally connected with each other.

12. A control device for an electrical circuit comprising:

a housing having a pair of chambers therein with one of said chamber adapted to be subjected to a control fluid pressure;

at least three terminals associated with said housing and including a switch section within the other of said chambers, respectively, at least two terminals of said at least three terminals also including electrical connector means extending from said other chamber exteriorly of said housing for connection in the electrical circuit, respectively;

at least a pair of switch means mounted with said switch section of one terminal of said at least two terminals within said other chamber and operable generally toward switching positions in circuit making engagement with said switch section of a third one of said terminals of said at least three terminals and said switch section of another terminal of said at least two terminals, respectively;

resistor means for energization in the electrical circuit and connected in series circuit relation between said third one terminal and said another terminal of said at least two terminals; and diaphragm means associated with said housing between said chambers and movable for controlling the operation of said switching means, respectively, said diaphragm means being initially movable when subjected to the control fluid pressure of a preselected value in said one chamber to effect the operation of one of said switch means to its switching position in circuit making engagement with said switch section of said third one terminal so as to effect the energization of said resistor means in its series circuit relation between said third one terminal and said another terminal of said at least two terminals in the electrical circuit and said diaphragm means being thereafter further movable when subjected to control fluid pressure of another preselected value predeterminately greater than the first named preselected value to subsequently effect the operation of the other of said switch means to its switching position in circuit making engagement with said switch section of said another terminal of said at least two terminals.

13. A control device as set forth in claim 12 wherein said resistor means is disposed within said chamber and includes a pair of opposite leads respectively connected with said switch section of said third one terminal and said switch section of said another terminal of said at least two terminals, respectively.

14. A control device as set forth in claim 12 wherein said third one terminal also includes electrical connector means extending from said other chamber exteriorly of said housing for connection in the electrical circuit, and said resistor means being disposed exteriorly of said housing and including a pair of opposite leads respectively connected in the series circuit relation with said electrical connector means of said third one terminal and said another terminal of said at least two terminals, respectively.

15. A method of making a control device having a pair of housing members, recess means in one of the housing members, a threaded opening in the one housing member intersecting with the recess means, first, second and third terminals having a switch section, respectively, and with the first and second terminals having an electrical connector section integral with the switch sections thereof, respectively, a diaphragm, a plunger, a spacer, a spring, a threaded adjuster, a pair of switch elements, and a resistor having a pair of opposite leads extending therefrom, the method comprising the steps of:

forming the switch element pair at least in part in spaced overlaying relation with an integral end portion therebetween and generally opposite a pair of free end portions on the switch element pair, respectively;

securing the integral end portion of the switch element pair with the switch section of the first terminal and connecting the opposite leads of the resistor with the switch sections of the second and third terminals, respectively;

locating in the recess means of the one housing member the switch sections of the second and third terminals having the resistor connected therewith with the switch sections of the second and third terminals being spaced apart generally at different elevations in the recess means and extending the electrical connector section of the second terminal from the recess means exteriorly of the one housing member;

disposing in the recess means the switch section of the first terminal having the switch element pair secured thereto with the free ends of the switch element pair being arranged generally in overlaying relation with the switch sections of the second and third terminals, respectively, and extending the electrical connector section of the first terminal from the recess means exteriorly of the one housing member generally in opposed spaced apart relation with the electrical connector section of the second terminal;

capturing the diaphragm between the housing members with the diaphragm extending across the recess means and positioning the plunger in the recess means between the switch element pair and in abutment with at least the diaphragm;

inserting an assembly of the spacer, spring and threaded adjuster at least in part through the threaded opening in the one housing member and engaging the spacer with the switch element pair, respectively; and threadedly engaging the threaded adjuster with the threaded opening in the one housing member so as to abut the spacer against the plunger compressing the spring between the spacer and the threaded adjuster and adjusting thereby the compressive force of the spring urged against the spacer engaged with the switch element pair so as to bias the free ends thereof toward positions spaced from the switch sections of the second and third terminals, respectively.

16. A method of making a control device having a housing with a chamber therein, first, second and third terminals including a switch section respectively, and with the first and second terminals including an electrical connector section integral with the switch section thereof, respectively, at least a pair of switch elements, and a resistor having a pair of opposite leads extending therefrom, the method comprising the steps of:

securing the at least pair of switch elements in electrical conductive relation to the switch section of the first terminal and connecting the opposite leads of the resistor in electrical conductive relation with the switch sections of the second and third terminals, respectively;

positioning in the housing chamber the switch sections of the second and third terminals having the resistor connected therebetween with the switch sections of the second and third terminals being disposed generally in adjacent spaced relation at different elevations in the housing chamber and extending the electrical connector section of the second terminal from the housing chamber exteriorly of the housing;

placing in the housing chamber the switch section of the first terminal having the at least switch element pair secured thereto with a part of the at least switch element pair being disposed in overlaying relation with the switch sections of the second and third terminals, respectively, and extending the electrical connector section of the first terminal from the housing chamber exteriorly of the housing;

deforming the switch section of the second terminal with respect to the switch section of the third terminal to predetermine the elevational different therebetween in the housing chamber and adjustably exerting a resilient force against the at least switch element pair.

17. A method of making a control device having a housing with a chamber therein, a plurality of terminals respectively including a switch section, at least a pair of switch elements, and a resistor, the method comprising the steps of:

securing the at least pair of switch elements in electrical conductive relation with the switch section of one of the terminals and connecting the resistor in circuit relation between the switch sections of another two of the terminals, respectively; and arranging in the housing chamber the switch section of the one terminal having the at least switch element pair secured thereto and the switch sections of the another two terminals having the resistor connected therebetween with the switch sections of the another two terminals being disposed generally in adjacent spaced relation at different elevations in the housing chamber and positioning the at least switch element pair with respect to the switch sections of the another two terminals for making and breaking association therewith, respectively.

18. The method as set forth in claim 17 wherein the one terminal and one of the another two terminals include a pair of electrical connector sections and wherein the arranging and positioning step includes disposing the electrical connector sections so as to extend exteriorly of the housing, respectively.

19. The method as set forth in claim 17 wherein the control device further includes a spacer and a spring and wherein the arranging and positioning step includes abutting the spacer with the at least switch element pair and engaging the spring between the spacer and a part of the housing.

20. The method as set forth in claim 19 wherein the housing part is adjustably movable in the housing and wherein the method comprises the additional step of adjustably moving the housing part to compress the spring and biasing thereby the at least switch element pair with the spacer therebetween toward positions broken from the switch sections of the another two terminals, respectively.

21. The method as set forth in claim 17 comprising the additional step of adjusting the switch section of one of the another two terminals with respect to the switch section of the other of the another two terminals to predetermine the elevation therebetween in the housing chamber.

22. The method as set forth in claim 17 comprising the additional step of adjustably biasing the at least switch element pair toward positions broken from the switch sections of the another two terminals.

23. The method as set forth in claim 17 comprising the preliminary step of attaching a spacer in engagement with the at least switch element pair.

24. The method as set forth in claim 23 comprising the additional step of adjustably exerting a resilient force on the spacer and biasing the at least switch element pair toward a position broken from the switch sections of the another two terminals, respectively.

25. A method of making a control device having a housing with a plurality of wall means defining a chamber therein, a plurality of terminals respectively including a switch section, at least a pair of switch elements, and a resistor having a pair of opposite leads extending therefrom, the method comprising the steps of:

placing the resistor and leads therefor in the chamber and locating the leads generally in preselected positions at least adjacent a pair of the wall means of the housing;

arranging in the chamber the switch section of one of the terminals and capturing one of the leads of the resistor between one of the wall means and the switch section of the one terminal in electrical conductive relation therewith;

positioning in the chamber the switch section of another of the terminals at an elevation different than that of the switch section of the one terminal and capturing the other of the leads of the resistor between the other of the wall means and the switch section of the another terminal in electrical conductive relation therewith;

disposing in the chamber the switch section of a third one of the terminals having the switch element pair secured thereto and locating a part of the switch element pair in overlaying relation with the switch sections of the one terminal and the another terminal for making and breaking association with respect thereto, respectively.

* * * * *